US012492457B2

(12) United States Patent
Takahashi et al.

(10) Patent No.: US 12,492,457 B2
(45) Date of Patent: Dec. 9, 2025

(54) PRECIPITATION HARDENING MARTENSITIC STAINLESS STEEL

(71) Applicant: DAIDO STEEL CO., LTD., Nagoya (JP)

(72) Inventors: Nobuyuki Takahashi, Nagoya (JP); Akihiko Okamoto, Nagoya (JP); Chihiro Furusho, Nagoya (JP); Hiroyuki Takabayashi, Nagoya (JP); Yoshihiko Koyanagi, Nagoya (JP)

(73) Assignee: DAIDO STEEL CO., LTD, Nagoya (JP)

( * ) Notice: Subject to any disclaimer, the term of this patent is extended or adjusted under 35 U.S.C. 154(b) by 196 days.

(21) Appl. No.: 17/157,534

(22) Filed: Jan. 25, 2021

(65) Prior Publication Data

US 2021/0238718 A1 Aug. 5, 2021

(30) Foreign Application Priority Data

Feb. 4, 2020 (JP) ..... 2020-016838
Oct. 22, 2020 (JP) ..... 2020-177624

(51) Int. Cl.

| | |
|---|---|
| ***C22C 38/54*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |

(52) U.S. Cl.

CPC ..... *C22C 38/54* (2013.01); *C21D 9/46* (2013.01); *C22C 38/002* (2013.01); *C22C 38/005* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/52* (2013.01); *C21D 2211/008* (2013.01)

(58) Field of Classification Search

CPC ..... C22C 38/54; C22C 38/002; C22C 38/005; C22C 38/02; C22C 38/04; C22C 38/06; C22C 38/44; C22C 38/48; C22C 38/50; C22C 38/52; C22C 38/46; C21D 2211/008

See application file for complete search history.

(56) References Cited

U.S. PATENT DOCUMENTS

| | | | | |
|---|---|---|---|---|
| 3,342,590 | A * | 9/1967 | Bieber | C22C 38/44 148/578 |
| 5,681,528 | A | 10/1997 | Martin et al. | |
| 5,855,844 | A | 1/1999 | Martin | |
| 8,663,403 | B2 | 3/2014 | Chen et al. | |
| 2003/0049153 | A1* | 3/2003 | Martin | C21D 6/02 420/38 |
| 2011/0255988 | A1 | 10/2011 | Oikawa et al. | |
| 2012/0321478 | A1 | 12/2012 | Oikawa et al. | |
| 2013/0186106 | A1* | 7/2013 | Oikawa | C21D 6/02 148/326 |
| 2014/0105753 | A1* | 4/2014 | Oikawa | C21D 1/18 416/241 R |
| 2014/0161658 | A1* | 6/2014 | Wert | C21D 6/004 420/41 |
| 2015/0132144 | A1 | 5/2015 | Oikawa et al. | |
| 2016/0319406 | A1 | 11/2016 | Wert et al. | |
| 2016/0333450 | A1 | 11/2016 | Ikeda et al. | |
| 2018/0320256 | A1 | 11/2018 | Wert et al. | |
| 2020/0080164 | A1* | 3/2020 | Vartanov | B22F 10/20 |

FOREIGN PATENT DOCUMENTS

| | | | | |
|---|---|---|---|---|
| CN | 105102649 | A | 11/2015 | |
| DE | 1232759 | B | 1/1967 | |
| JP | S63-171857 | A | 7/1988 | |
| JP | S64-025952 | A | 1/1989 | |
| JP | H02-190416 | A | 7/1990 | |
| JP | H02-225649 | A | 9/1990 | |
| JP | H04-173926 | A | 6/1992 | |
| JP | H06-158228 | A | 6/1994 | |
| JP | H09-143626 | A | 6/1997 | |
| JP | 2004-522859 | T | 7/2004 | |
| JP | 2005-298840 | A | 10/2005 | |
| JP | 2013-001949 | A | 1/2013 | |
| JP | 2013-147698 | A | 8/2013 | |
| JP | 2014-080656 | A | 5/2014 | |
| JP | 2014-201792 | A | 10/2014 | |
| JP | 2015-093991 | A | 5/2015 | |
| JP | 2016-504498 | T | 2/2016 | |
| JP | 5974380 | B2 * | 8/2016 | C21D 6/02 |
| TW | 490493 | B | 6/2002 | |
| WO | WO 2015/137507 | A1 | 9/2015 | |

OTHER PUBLICATIONS

Canadian Office Action, dated Dec. 14, 2021, in Canadian Application No. 3,106,648 and English Translation thereof.

(Continued)

*Primary Examiner* — Anthony M Liang

(74) *Attorney, Agent, or Firm* — MCGINN I.P. LAW GROUP, PLLC

(57) ABSTRACT

The present invention relates to a precipitation-hardening martensitic stainless steel, containing: 0<C<0.10 mass %, 0<Si≤0.20 mass %, 0<Mn≤1.00 mass %, 8.0 mass %≤Ni≤15.0 mass %, 8.0 mass %≤Cr≤14.0 mass %, 0.4 mass %≤Nb≤2.50 mass %, and the balance being Fe and inevitable impurities. The precipitation-hardening martensitic stainless steel has a 0.2% proof stress of 1,300 MPa or more at room temperature and has an absorption energy of 30 J or more at room temperature. The precipitation-hardening martensitic stainless steel has an absorption energy of 10 J or more at −40° C.

12 Claims, No Drawings

(56) References Cited

OTHER PUBLICATIONS

Chinese Office Action, dated Dec. 31, 2021, in Chinese Application No. 202110125918.9 and English Translation thereof.
French Office Action, dated May 2, 2022, in French Application No. 2100952 and English Translation thereof.
Chinese Office Action, dated May 20, 2022, in Chinese Application No. 202110125918.9 and English Translation thereof.
"High Strength/Ultra High Strength Stainless Steel", Edited by Xiancun Zhao et al., Beijing, Metallurgical Industry Press, Beijing, Open Date is May 31, 2008, p. 559.
Chinese Office Action, dated Aug. 30, 2022, in Chinese Application No. 202110125918.9 and English Translation thereof.
"Stainless Steel Handbook", (US) Peckner (Peckner, D.), (US) Bernstein (Bernstein, I.M.) editor-in-chief, translated by Shouren Gu, etc., Machinery Industry Press, published on Mar. 31, 1987, pp. 281-282.
"Metallographic Analysis Principles and Techniques", Songzan Ren, etc., Shanghai Science and Technology Literature Publishing House, published on Aug. 31, 2013, pp. 562-564.
Taiwanese Office Action, dated Aug. 17, 2021, in Taiwanese Application No. 110102917 and English Translation thereof.
French Office Action, dated Mar. 30, 2023, in French Application No. FR2100952 and English Translation thereof.
Japanese Office Action, dated Jul. 9, 2024 in Japanese Application No. 2020-177624 and English Translation therefor.
Chinese Office Action dated Jul. 9, 2025 in Chinese Patent Application No. 202110125918.9 with machine English translation.
Chinese Office Action dated Oct. 29, 2025 in Chinese Patent Application No. 202110125918.9 with machine English translation.

* cited by examiner

PRECIPITATION HARDENING MARTENSITIC STAINLESS STEEL

TECHNICAL FIELD

The present invention relates to a precipitation-hardening martensitic stainless steel, and more particularly to a precipitation-hardening martensitic stainless steel excellent in strength and toughness at room temperature and excellent in toughness at a low temperature.

BACKGROUND

The precipitation-hardening stainless steel refers to steel in which a small amount of Al, Cu, Mo, Ti, or the like is added to a Cr—Ni stainless steel, and an intermetallic compound is precipitated in a matrix phase by heat treatment. The precipitation-hardening stainless steel is classified into a martensitic stainless steel, a semi-austenitic stainless steel, and an austenitic stainless steel depending on a structure of the matrix phase. Among these, a precipitation-hardening martensitic stainless steel such as SUS 630, PH 13-8 Mo, or Custom 465 is excellent in corrosion resistance, strength, and toughness, and is therefore used in aerospace structural members or the like.

Regarding such a precipitation-hardening martensitic stainless steel, various proposals have been made hitherto.

For example, Patent Literature 1 discloses a precipitation-hardening martensitic stainless steel where an intermetallic compound is dispersed and precipitated, the martensitic stainless steel containing 0.1 mass % or less of C, 11 mass % or more and 13 mass % or less of Cr, 7.5 mass % or more and 11 mass % or less of Ni, 0.9 mass % or more and 1.7 mass % or less of Al, 0.85 mass % or more and 1.35 mass % or less of Mo, 1.75 mass % or more and 2.75 mass % or less of W, and the balance being Fe and inevitable impurities, in which the Mo content and the W content satisfy a predetermined relationship.

The literature describes that such a precipitation-hardening martensitic stainless steel has a high level of balance between mechanical strength and toughness and has excellent corrosion resistance.

Patent Literature 2 discloses a precipitation-hardening martensitic stainless steel containing, on a mass basis, C: 0.1% or less, Cr: 11% to 13%, Ni: 10.5% to 11.5%, Al: 0.25% or less, Ti: 0.9% to 1.5%, Mo+0.5 W: 0.5% to 1.5%, Si: 1.0% or less, Mn: 1.0% or less, Mo/W (mass % ratio): 0.4 to 0.6, and the balance being iron and inevitable impurities.

The literature describes that such a precipitation-hardening martensitic stainless steel has excellent structural stability, mechanical characteristics, and corrosion resistance.

Patent Literature 3 discloses a precipitation-hardening martensitic stainless steel containing, on a mass basis, 0.1% or less of C, 0.1% or less of N, 9.0% or more and 14.0% or less of Cr, 9.0% or more and 14.0% or less of Ni, 0.5% or more and 2.5% or less of Mo, 0.5% or less of Si, 1.0% or less of Mn, 0.25% or more and 1.75% or less of Ti, 0.25% or more and 1.75% or less of Al, and the balance being Fe and inevitable impurities.

The literature describes that such a precipitation-hardening martensitic stainless steel has excellent structural stability, strength, toughness, and corrosion resistance and does not require a sub-zero treatment.

Patent Literature 4 discloses a precipitation-hardening martensitic stainless steel containing, on a mass basis, 0.05% or less of C, 0.05% or less of N, 10.0% or more and 14.0% or less of Cr, 8.5% or more and 11.5% or less of Ni, 0.5% or more and 3.0% or less of Mo, 1.5% or more and 2.0% or less of Ti, 0.25% or more and 1.00% or less of Al, 0.5% or less of Si, 1.0% or less of Mn, and the balance being Fe and inevitable impurities. The literature describes that such a precipitation-hardening martensitic stainless steel has excellent structural stability, strength, toughness, and corrosion resistance and does not require a sub-zero treatment.

Patent Literature 5 discloses a corrosion resistant maraging alloy that is not a precipitation-hardening martensitic stainless steel but contains 47.4 weight % to 82.4 weight % of Fe, 6 weight % to 9 weight % of Ni, 11 weight % to 15 weight % of Cr, 0.5 weight % to 6 weight % of Mo+½ W, each 0 to 6 weight % of one or more of Co and Cu, each 0 to 1 weight % of one or more of Ti, Nb, Al, Si, Mn, and V, each 0 to 0.1 weight % of one or more of rare earth or composite metals, 0 to 0.1 weight % of C and N, and 0.1 weight % to 0.5 weight % of Be.

The literature describes that such a corrosion resistant maraging alloy can obtain a high hardness of 550 HV or more while maintaining existing corrosion resistance after age hardening.

Furthermore, Patent Literature 6 discloses a martensitic stainless steel containing C: 0.15% or less (not including 0), Si: 6.0% or less (not including 0), Mn: 10.0% or less (not including 0), Ni: 8.0% or less (not including 0), Cr: 10.0% to 17.0%, N: 0.3% or less (not including 0), Mo: 4.0% or less (including 0), Cu: 4.0% or less (including no addition), Co: 4.0% or less (including 0), a Ni equivalent value being in a range of 8.0 to 17.5, and the balance being Fe and inevitable impurities.

The literature describes that, when an appropriate heat treatment is performed on such a martensitic stainless steel, fatigue characteristics are improved.

The precipitation-hardening martensitic stainless steel is characterized in that fine precipitates are dispersed to obtain strength. For example, in PH 13-8 Mo, Al is used as a strengthening element, and NiAl is precipitated to obtain high strength and high toughness (strong toughness). In Custom 465, Ti is used as a strengthening element, and $Ni_3Ti$ is precipitated to obtain strong toughness.

However, conventional precipitation-hardening martensitic stainless steels are embrittled at a low temperature, and thus their use at a low temperature has been restricted. In addition, a precipitation-hardening martensitic stainless steel showing high toughness even at a low temperature has not been proposed in the related art.

Patent Literature 1: JP-A-2015-093991
Patent Literature 2: JP-A-2014-201792
Patent Literature 3: JP-A-2013-147698
Patent Literature 4: JP-A-2013-001949
Patent Literature 5: JP-A-H09-143626
Patent Literature 6: JP-A-H04-173926

SUMMARY

An object of the present invention is to provide a precipitation-hardening martensitic stainless steel excellent in strength and toughness at room temperature and excellent in toughness at a low temperature.

In order to solve the above problem, a precipitation-hardening martensitic stainless steel according to the present invention contains:

$0<C<0.10$ mass %,
$0<Si\leq 0.20$ mass %,
$0<Mn\leq 1.00$ mass %,
8.0 mass % $\leq Ni \leq$ 15.0 mass %,
8.0 mass % $\leq Cr \leq$ 14.0 mass %,
0.4 mass % $\leq Nb \leq$ 2.50 mass %, and
the balance being Fe and inevitable impurities.

In the conventional precipitation-hardening martensitic stainless steels, Nb has been rarely used as a strengthening element. This is because when Nb is added, a harmful phase is easily generated. However, when an appropriate amount of Nb is added as a strengthening element to the precipitation-hardening martensitic stainless steel and heat treatment is performed under appropriate conditions, high strength and high toughness are exhibited at room temperature, and high toughness is also exhibited even at a low temperature.

When an appropriate amount of Nb is added and heat treatment is performed under appropriate conditions, $Ni_3Nb$ is precipitated in a matrix phase. It is considered that expression of high toughness at a low temperature relates to the shape of the precipitated $Ni_3Nb$ grains and consistency between the $Ni_3Nb$ grains and the matrix phase.

EMBODIMENTS

Hereinafter, an embodiment of the present invention will be described in detail.

[1. Precipitation-Hardening Martensitic Stainless Steel]

[1.1. Main Constituent Elements]

The precipitation-hardening martensitic stainless steel according to the present invention contains the following elements, with the balance being Fe and inevitable impurities. Kinds of the added elements, the content ranges thereof, and the reasons for limiting those are as follows.

(1) 0<C<0.10 mass %:

C precipitates a $M_2X$ type carbon nitride and contributes to an improvement in strength of a base metal. Furthermore, C also contributes to a refinement of the prior austenite grain diameter. In order to obtain such effects, the C content needs to be more than 0 mass %. The C content is preferably 0.0005 mass % or more, and more preferably 0.0020 mass % or more.

On the other hand, when the C content is excessive, it becomes necessary to raise a solid solution temperature because a large amount of the $M_2X$ type carbon nitride precipitates. For that reason, austenite grains coarsen at the time of solid solution, which causes characteristic variation. In addition, at the time of aging treatment, (Cr, Mo) carbides are excessively precipitated, and toughness and corrosion resistance are deteriorated. Furthermore, a martensite transformation-starting temperature (Ms point) decreases to stabilize the austenite phase. Therefore, the C content needs to be less than 0.10 mass %. The C content is preferably 0.05 mass % or less, and more preferably 0.01 mass % or less.

(2) 0<Si≤0.20 mass %:

Si acts as a deoxidizer. When the Si content is too small, deoxidation at the time of dissolution is insufficient, and cleanliness decreases. Therefore, the Si content needs to be more than 0 mass %. The Si content is preferably 0.005 mass % or more.

On the other hand, when the Si content is excessive, an oxide inclusion is formed, 20 and toughness decreases. Therefore, the Si content needs to be 0.20 mass % or less. The Si content is preferably 0.15 mass % or less, and more preferably 0.10 mass % or less.

(3) 0<Mn≤1.00 mass %:

Mn has an effect of reducing grain boundary segregation of S mixed as an impurity. In order to obtain such an effect, the Mn content needs to be more than 0 mass %. The Mn content is preferably 0.005 mass % or more.

On the other hand, when the Mn content is excessive, sulfide increases and toughness decreases. In addition, the Ms point decreases and the austenite phase is stabilized. Therefore, the Mn content needs to be 1.00 mass % or less. The Mn content is 30 preferably 0.50 mass % or less, and more preferably 0.20 mass % or less.

(4) 8.0 mass %≤Ni≤15.0 mass %:

Ni is an important element that precipitates an intermetallic compound phase such as NiAl or $Ni_3$ (Al, Ti) and contributes to the improvement in strength of the base metal. In addition, Ni has action of suppressing formation of a 8 ferrite phase. Furthermore, Ni lowers a ductile-brittle transition temperature (DBTT) of a matrix phase, and contributes to the improvement in toughness at room temperature. In order to obtain such effects, the Ni content needs to be 8.0 mass % or more. The Ni content is preferably 9.0 mass % or more, and more preferably 10.0 mass % or more.

On the other hand, when the Ni content is excessive, the Ms point decreases. Therefore, residual austenite increases, and the strength decreases. Therefore, the Ni content needs to be 15.0 mass % or less. The Ni content is preferably 13.5 mass % or less, and more preferably 13.0 mass % or less.

(5) 8.0 mass %≤Cr≤14.0 mass %:

Cr contributes to adjustment of the Ms point, and as the Cr content decreases, the Ms point increases. Therefore, as the Cr content decreases, the residual austenite after a solid solution heat treatment or after a sub-zero treatment decreases. Hereby, homogeneity of a microstructure is improved, and 0.2% proof stress is improved.

On the other hand, Cr is an element necessary to ensure corrosion resistance. When the Cr content is small, a $M_{23}C_6$ type carbide, which is coarser than the $M_2X$ type carbon nitride, is stabilized, and the 0.2% proof stress decreases. Therefore, the Cr content needs to be 8.0 mass % or more. The Cr content is preferably 8.5 mass % or more.

On the other hand, as the Cr content increases, the Ms point decreases. Therefore, when the Cr content is excessive, the residual austenite amount before the aging treatment is excessive, and the 0.2% proof stress decreases. Furthermore, when the Cr content is excessive, the & ferrite phase is easily formed. Therefore, the Cr content needs to be 14.0 mass % or less. The Cr content is preferably 12.0 mass % or less, and more preferably 10.0 mass % or less.

(6) 0.4 mass %≤Nb≤2.50 mass %:

Nb precipitates a rod-shaped $Ni_3Nb$ grain having a width of 2 nm to 20 nm and a length of about several dozens of nm, and contributes to the improvement in the strength of the base metal. When Al or Ti is added into steel, that is, when an intermetallic compound such as NiAl or $Ni_3$ (Al, Ti) is contained in steel, Nb forms Ni (Al, Nb), $Ni_3$ (Al, Ti, Nb) or the like in which a part of Al or Ti in NiAl or $Ni_3$ (Al, Ti) is substituted with Nb, which contributes to the improvement in the strength of the base metal. Furthermore, Nb forms a carbon nitride and contributes to the refinement of crystal grains.

In order to obtain such effects, the Nb content needs to be 0.4 mass % or more. The Nb content is preferably 0.50 mass % or more, and more preferably 0.60 mass % or more.

On the other hand, when the Nb content is excessive, a precipitation-strengthening phase and inclusion increase, and toughness is deteriorated. Furthermore, when the Nb content is excessive, the 8 ferrite phase is easily formed. Therefore, the Nb content needs to be 2.50 mass % or less. The Nb content is preferably 1.50 mass % or less, and more preferably 1.00 mass % or less.

(7) Inevitable impurities:

In the present invention, the "inevitable impurities" refer to trace components incorporated from a raw material or a refractory during production of the stainless steel. The inevitable impurities specifically include the following.

(a) P≤0.050 mass %:

P deteriorates toughness and ductility of steel. In addition, P deteriorates hot workability due to grain boundary segregation. However, in the case where the P content is 0.050 mass % or less, there are few adverse effects.

(b) S≤0.050 mass %:

S deteriorates toughness and ductility of steel. In addition, S deteriorates hot workability due to grain boundary segregation. Furthermore, S bonds to Ti to form a sulfide inclusion. However, in the case where the S content is 0.050 mass % or less, there are few adverse effects.

(c) N≤0.050 mass %:

N forms a nitride and deteriorates the toughness and ductility. Furthermore, N lowers the Ms point and stabilizes the austenite phase. However, in the case where the N content is 0.050 mass % or less, there are few adverse effects. The N content is preferably 0.03 mass % or less, and more preferably 0.01 mass % or less.

(d) O≤0.010 mass %:

O forms an oxide inclusion and deteriorates the toughness. However, in the case where the O content is 0.010 mass % or less, there are few adverse effects.

(e) Al<0.10 mass %:

(f) Ti<0.10 mass %:

As will be described later, Al and Ti are elements that precipitate an intermetallic compound and contribute to the improvement in the strength of the base metal, and are also elements that can be mixed as the inevitable impurities. When Al and Ti are managed as the inevitable impurities, Al and Ti each are limited to be less than 0.10 mass %. In addition, when Al and Ti are managed as the inevitable impurities, lower limits thereof do not need to be particularly limited and are 0 mass %.

(g) Cu<0.30 mass %:

When Cu is in trace amounts, there is an effect of improving the strength without greatly impairing the toughness, whereas when the Cu content is excessive, toughness and hot workability may deteriorate in some cases. Therefore, the upper limit value of the Cu content is limited to be less than 0.30 mass %, preferably less than 0.10 mass %. In addition, when Cu is mixed as the inevitable impurities, the lower limit thereof does not need to be particularly limited and is 0 mass %.

(h) Mo<0.10 mass %:

(i) W<0.10 mass %:

(j) Co<0.10 mass %:

(k) V<0.30 mass %:

As will be described later, Mo, W, Co, and V each are elements that contribute to the improvement in the strength of the base metal, and are also elements that can be mixed as the inevitable impurities. When Mo, W, Co, and V are managed as the inevitable impurities, Mo, W, Co, and V each are limited to be less than the above respective value. In addition, when Mo, W, Co, and V are managed as the inevitable impurities, lower limits thereof do not need to be particularly limited and are 0 mass %.

[1.2. Sub-Constituent Elements]

The precipitation-hardening martensitic stainless steel according to the present invention may further contain one or two or more of the following elements in addition to the elements described above. Kinds of the added elements, the content ranges thereof, and the reasons for limiting those are as follows.

(8) 0.10 mass %<Al≤2.50 mass %:

Al forms an intermetallic compound (spherical NiAl of 2 nm to 20 nm) with Ni, and contributes to the improvement in the strength of the base metal. In addition, Al also functions as a deoxidizing element. In order to obtain such effects, the Al content can be 0.10 mass % or more. The Al content is more preferably 0.30 mass % or more, further preferably 0.50 mass % or more, and even more preferably 0.70 mass % or more.

On the other hand, when the Al content is excessive, a precipitation-strengthening phase and an inclusion increase, and the toughness deteriorates. Furthermore, when the Al content is excessive, the 8 ferrite phase is easily formed. Therefore, the Al content is preferably 2.50 mass % or less. The Al content is more preferably 2.00 mass % or less, and further preferably 1.50 mass % or less.

(9) 0.10 mass %≤Ti≤1.50 mass %:

As with Al, Ti forms an intermetallic compound (rod shaped $Ni_3Ti$ having a width of about 2 nm to 20 nm and a length of about several dozens of nm) with Ni, and contributes to the improvement in the strength of the base metal. As a result, grain boundary strength is improved, which contributes to the improvement in the toughness. Furthermore, Ti forms a carbon nitride and contributes to the refinement of crystal grains. In order to obtain such effects, the Ti content is preferably 0.10 mass % or more.

On the other hand, when the Ti content is excessive, a precipitation-strengthening phase and an inclusion increase, and the toughness deteriorates. Furthermore, when the Ti content is excessive, the & ferrite phase is easily formed. Therefore, the Ti content is preferably 1.50 mass % or less. The Ti content is more preferably 1.30 mass % or less, and further preferably 1.10 mass % or less.

Either one of Ti and Al may be added, or both of Ti and Al may be added. However, when the Al content is 0.10 mass % or more and 2.50 mass % or less, the Ti content is preferably less than 0.10 mass %. This is because a Ni (Al, Nb) intermetallic compound is superior to a Ni (Ti, Nb) intermetallic compound in an effect of improving the strength without impairing the toughness.

(10) 0.10 mass %≤Co≤10.0 mass %:

Co has an action of promoting precipitation of a fine precipitate phase that affects the strength. In order to obtain such an effect, the Co content is preferably 0.10 mass % or more. The Co content is more preferably 3.0 mass % or more, and further preferably 6.0 mass % or more.

On the other hand, when the Co content is excessive, cost rises. Therefore, the Co content is preferably 10.0 mass % or less. The Co content is more preferably 9.0 mass % or less, and further preferably 8.0 mass % or less.

(11) 0.10 mass % ≤Mo≤3.0 mass %:

Mo precipitates a $M_2X$ type carbon nitride and contributes to the improvement in strength of a base metal. Mo also contributes to the refinement of the prior austenite grain diameter. Furthermore, Mo contributes to the improvements in strength, toughness, and corrosion resistance. In order to obtain such effects, the Mo content is preferably 0.10 mass % or more. The Mo content is more preferably 0.3 mass % or more, and further preferably 0.5 mass % or more.

On the other hand, when the Mo content is excessive, it becomes necessary to raise a solid solution temperature because a large amount of the $M_2X$ type carbon nitride precipitates. For that reason, austenite grains coarsen at the time of solid solution, which causes characteristic variation. Furthermore, when the Mo content is excessive, the & ferrite phase is easily formed. Therefore, the Mo content is preferably 3.0 mass % or less. The Mo content is more preferably 2.5 mass % or less, and further preferably 2.0 mass % or less.

(12) 0.10 mass %≤W≤3.0 mass %:

W precipitates a $M_2X$ type carbon nitride and contributes to the improvement in strength of a base metal. W also contributes to the refinement of the prior austenite grain diameter. Furthermore, W contributes to the improvements in strength, toughness, and corrosion resistance. In order to obtain such effects, the W content is preferably 0.10 mass % or more. The W content is more preferably 0.3 mass % or more, and further preferably 0.5 mass % or more.

On the other hand, when the W content is excessive, it becomes necessary to raise a solid solution temperature because a large amount of the $M_2X$ type carbon nitride precipitates. For that reason, austenite grains coarsen at the time of solid solution, which causes characteristic variation. Furthermore, when the W content is excessive, the & ferrite phase is easily formed. Therefore, the W content is preferably 3.0 mass % or less. The W content is more preferably 2.5 mass % or less, and further preferably 2.0 mass % or less.

(13) 0.3 mass %≤V≤2.0 mass %:

When Al or Ti is added into steel, that is, when an intermetallic compound such as NiAl or $Ni_3$ (Al, Ti) is contained in steel, V forms Ni (Al, V), $Ni_3$ (Al, Ti, V) or the like in which a part of Al or Ti in NiAl or $Ni_3$ (Al, Ti) is substituted with V, thereby contributing to the improvement in the strength of the base metal. Furthermore, V forms a carbon nitride and contributes to the refinement of crystal grains.

In order to obtain such effects, the V content is preferably 0.3 mass % or more.

On the other hand, when the V content is excessive, a precipitation-strengthening phase and inclusion increase, and the toughness deteriorates. Furthermore, when the V content is excessive, the 8 ferrite phase is easily formed. Therefore, the V content is preferably 2.0 mass % or less. The V content is more preferably 1.5 mass % or less, and further preferably 1.0 mass % or less.

(14) 0.01 mass %≤Ta≤1.0 mass %:

When Al or Ti is added into steel, that is, when an intermetallic compound such as NiAl or $Ni_3$ (Al, Ti) is contained in steel, Ta forms Ni (Al, Ta), $Ni_3$ (Al, Ti, Ta) or the like in which a part of Al or Ti in NiAl or $Ni_3$ (Al, Ti) is substituted with Ta, thereby contributing to the improvement in the strength of the base metal. Furthermore, Ta forms a carbon nitride and contributes to the refinement of crystal grains.

In order to obtain such effects, the Ta content is preferably 0.01 mass % or more.

On the other hand, when the Ta content is excessive, a precipitation-strengthening phase and inclusion increase, and the toughness deteriorates. Furthermore, when the Ta content is excessive, the 8 ferrite phase is easily formed. Therefore, the Ta content is preferably 1.0 mass % or less.

(15) 0.0001 mass %≤B≤0.0100 mass %:

B improves the grain boundary strength and contributes to the improvement in the toughness. In order to obtain such an effect, the B content is preferably 0.0001 mass % or more. The B content is more preferably 0.0005 mass % or more, and further preferably 0.0010 mass % or more.

On the other hand, when the B content is excessive, a large amount of BN is formed and the toughness deteriorates. Therefore, the B content is preferably 0.0100 mass % or less. The B content is more preferably 0.0050 mass % or less, and further preferably 0.0030 mass % or less.

(16) 0.0001 mass %≤Ca≤0.0100 mass %:

Ca has an action of refining carbides or oxides and refining the crystal grains, which contributes to the improvement in the toughness. In order to obtain such an effect, the Ca content is preferably 0.0001 mass % or more.

On the other hand, when the Ca content is excessive, hot workability deteriorates. Therefore, the Ca content is preferably 0.0100 mass % or less. The Ca content is more preferably 0.0050 mass % or less.

(17) 0.0001 mass %≤Mg≤0.0100 mass %:

Mg has an action of refining carbides or oxides and refining the crystal grains, which contributes to the improvement in the toughness. In order to obtain such an effect, the Mg content is preferably 0.0001 mass % or more.

On the other hand, when the Mg content is excessive, the hot workability deteriorates. Therefore, the Mg content is preferably 0.0100 mass % or less. The Mg content is more preferably 0.0050 mass % or less.

(18) 0.001 mass %≤Zr≤0.050 mass %:

Zr has an action of refining carbides or oxides and refining the crystal grains, which contributes to the improvement in the toughness. In order to obtain such an effect, the Zr content is preferably 0.001 mass % or more.

On the other hand, when the Zr content is excessive, the hot workability deteriorates. Therefore, the Zr content is preferably 0.050 mass % or less. The Zr content is preferably more 0.030 mass % or less.

(19) 0.001 mass %≤REM≤0.050 mass %:

REM (rare-earth metals) has an action of refining carbides or oxides and refining the crystal grains, which contributes to the improvement in the toughness. In order to obtain such an effect, the REM content is preferably 0.001 mass % or more.

On the other hand, when the REM content is excessive, the hot workability deteriorates. Therefore, the REM content is preferably 0.050 mass % or less. The REM content is more preferably 0.030 mass % or less.

[1.3. Characteristics]

[1.3.1. 0.2% Proof Stress]

The precipitation-hardening martensitic stainless steel according to the present invention exhibits a relatively high 0.2% proof stress when the components are optimized and an appropriate heat treatment is performed.

Specifically, when the components and heat treatment conditions are optimized, the 0.2% proof stress at room temperature reaches 1,300 MPa or more. When the components and the heat treatment conditions are further optimized, the 0.2% proof stress at room temperature reaches 1,400 MPa or more.

[1.3.2. Absorption Energy]

The precipitation-hardening martensitic stainless steel according to the present invention exhibits relatively high absorption energy when the components are optimized and an appropriate heat treatment is performed.

Specifically, when the components and the heat treatment conditions are optimized, the absorption energy at room temperature reaches 30 J or more. When the components and the heat treatment conditions are further optimized, the absorption energy at room temperature reaches 50 J or more.

Furthermore, when the components and the heat treatment conditions are optimized, the absorption energy at −40° C. reaches 10 J or more. When the components and the heat treatment conditions are further optimized, the absorption energy at −40° C. reaches 20 J or more.

[2. Method for Producing Precipitation-Hardening Martensitic Stainless Steel]

The precipitation-hardening martensitic stainless steel according to the present invention can be produced by (a) melting and casting raw materials combined to have a predetermined composition to obtain an ingot,
(b) performing a homogenized heat treatment on the obtained ingot,
(c) hot-forging a material after the homogenized heat treatment,
(d) performing a solid solution heat treatment on the hot-forged material,
(e) performing a sub-zero treatment on a material after the solid solution heat treatment as necessary, and
(f) performing an aging treatment on a material after the solid solution heat treatment or after the sub-zero treatment.

[2.1. Melting and Casting Step]

First, the raw materials combined to have a predetermined composition is melted and casted to obtain an ingot. A method and conditions of melting and casting are not particularly limited, and an optimum method and conditions can be selected according to the object.

[2.2. Homogenized Heat Treatment Step]

Next, a homogenized heat treatment is performed on the obtained ingot. The homogenized heat treatment is performed in order to remove segregation occurring during casting. Conditions of the homogenized heat treatment are not particularly limited as long as such an effect is achieved. In general, the homogenized heat treatment is performed by heating and holding the ingot under conditions of a temperature of 1,150° C. to 1,240° C. for 10 hr or more.

[2.3. Hot-Forging Step]

Next, the material after the homogenized heat treatment is hot-forged. Hot-forging is performed in order to break a coarse cast structure to refine the structure. Conditions of the hot-forging are not particularly limited as long as such an effect is achieved. In general, hot-forging is performed by heating the material under conditions of 700° C. to 1,240° C. for 1 hr or more, forging the material under conditions of a forging temperature of 700° C. to 1,300° C., and then air-cooling the material. The hot-forging may be carried out continuously after the homogenized heat treatment is performed, without cooling the material to room temperature.

[2.4. Solid Solution Heat Treatment Step]

Next, a solid solution heat treatment is performed on the material after the hot-forging. The solid solution heat treatment is performed in order to convert the material into an austenite single phase and then transform the material into martensite. Conditions of the solid solution heat treatment are not particularly limited as long as such an effect is achieved. In general, the solid solution heat treatment is performed by heating the material under conditions of a temperature of 800° C. to 1,200° C. for 1 hr to 10 hr and cooling the material. Examples of the cooling method include air-cooling, air blast-cooling, oil-cooling, and water-cooling.

[2.5. Sub-Zero Treatment Step]

A sub-zero treatment is performed on the material after the solid solution heat treatment as necessary. The sub-zero treatment is performed in order to transform austenite remaining after the solid solution heat treatment into martensite. Conditions of the sub-zero treatment are not particularly limited as long as such an effect is achieved. In general, the sub-zero treatment is performed by holding the material at a temperature of 0° C. or lower for 1 hr to 10 hr.

[2.6. Aging Treatment Step]

Next, an aging treatment is performed on the material after the solid solution heat treatment or after the sub-zero treatment. The aging treatment is performed in order to precipitate an intermetallic compound phase such as a B2 phase or a n phase in the matrix phase. Conditions of the aging treatment are not particularly limited as long as such an effect is achieved. In general, the aging treatment is performed by heating the material at 400° C. to 600° C. for 1 hr to 24 hr. After the heat treatment, cooling is performed by air-cooling.

[3. Action]

Precipitation-hardening martensitic stainless steels have excellent toughness at room temperature, but at the same time, also have a characteristic of embrittling at a low temperature. Therefore, conventional precipitation-hardening martensitic stainless steels are difficult to satisfy conditions of the 0.2% proof stress at room temperature being 1,300 MPa or more, the absorption energy at room temperature being 30 J or more, and the absorption energy at a low temperature (−40° C.) being 10 J or more at the same time.

Therefore, in general, austenitic stainless steels having excellent toughness at a low temperature are often used as a member used in a low temperature environment. However, the austenitic stainless steels are inferior in strength and toughness at room temperature as compared with the precipitation-hardening martensitic stainless steels, and therefore are limited on design.

In contrast, in the conventional precipitation-hardening martensitic stainless steels, Nb has been rarely used as a strengthening element. This is because when Nb is added, a harmful phase is easily generated. However, when an appropriate amount of Nb is added as a strengthening element to the precipitation-hardening martensitic stainless steel and heat treatment is performed under appropriate conditions, high strength and high toughness are exhibited at room temperature, and high toughness is exhibited even at a low temperature.

When an appropriate amount of Nb is added and heat treatment is performed under appropriate conditions, $Ni_3Nb$ is precipitated in a matrix phase. It is considered that expression of high toughness at a low temperature relates to the shape of the precipitated $Ni_3Nb$ grains and consistency between the $Ni_3Nb$ grains and the matrix phase.

Furthermore, when Al and/or Ti are compositely added in addition to Nb, the strength and toughness at room temperature and the toughness at a low temperature are further improved.

When Co is added in addition to Nb, the strength and toughness at room temperature can be further improved. It is considered that this is because precipitation of a strengthening phase is promoted by adding Co.

Therefore, the precipitation-hardening martensitic stainless steel according to the present invention can satisfy the followings at the same time:

(a) 0.2% proof stress (at room temperature) ≥1,300 MPa,
(b) absorption energy (at room temperature) ≥30 J, and
(c) absorption energy (at −40° C.) ≥10 J.

EXAMPLES

Examples 1 to 36 and Comparative Examples 1 to 10

[1. Production of Sample]

In a vacuum induction furnace, 50 kg of steel having the respective composition shown in Tables 1, 2 and 3 was melted and casted into an ingot. Thereafter, a homogenized heat treatment was performed on the ingot under conditions of 1,200° C. for 24 hr and air-cooling. Furthermore, a round bar having a diameter of 24 mm was forged under conditions of a start temperature of 1,200° C. and a termination temperature of 900° C., followed by air-cooling.

Next, each steel ingot was subjected to a solid solution heat treatment under conditions of 1000° C. for 1 hr and water-cooling. Subsequently, a sub-zero treatment was performed under conditions o f−76° C. for 6 hr. Furthermore, an aging treatment was performed under conditions of 530° C. for 4 hr and air-cooling.

TABLE 1

| | Component (mass %) | | | | | | | | | | | | | | |
|---|---|---|---|---|---|---|---|---|---|---|---|---|---|---|---|
| | C | Si | Mn | P | S | Ni | Cr | N | Al | Ti | Nb | Cu | Fe | Mo | Others |
| Example 1 | 0.011 | 0.02 | 0.03 | 0.005 | 0.003 | 10.8 | 9.3 | 0.005 | <0.01 | <0.01 | 1.59 | 0.02 | bal. | 1.1 | — |
| Example 2 | 0.005 | 0.03 | 0.08 | 0.006 | 0.004 | 11.0 | 8.6 | 0.005 | <0.01 | 0.80 | 0.71 | <0.01 | bal. | 1.0 | — |
| Example 3 | 0.004 | 0.01 | 0.03 | 0.005 | 0.003 | 11.3 | 9.2 | 0.008 | <0.01 | 1.06 | 0.62 | 0.02 | bal. | 0.5 | — |
| Example 4 | 0.007 | 0.03 | 0.04 | 0.007 | 0.003 | 11.2 | 9.0 | 0.005 | 0.81 | <0.01 | 0.83 | 0.01 | bal. | 1.5 | — |
| Example 5 | 0.005 | 0.03 | 0.03 | 0.009 | 0.003 | 11.9 | 9.1 | 0.004 | 1.19 | <0.01 | 0.62 | 0.01 | bal. | 1.1 | — |
| Example 6 | 0.008 | 0.04 | 0.02 | 0.005 | 0.004 | 12.3 | 9.1 | 0.005 | 0.45 | 0.51 | 0.73 | 0.02 | bal. | 1.4 | — |
| Example 7 | 0.007 | 0.02 | 0.12 | 0.006 | 0.003 | 11.0 | 8.9 | 0.010 | <0.01 | 0.75 | 1.22 | <0.01 | bal. | 1.2 | — |
| Example 8 | 0.009 | 0.03 | 0.03 | 0.005 | 0.005 | 11.6 | 9.2 | 0.006 | 0.80 | <0.01 | 1.21 | 0.02 | bal. | 1.1 | — |
| Example 9 | 0.050 | 0.04 | 0.05 | 0.007 | 0.004 | 11.5 | 9.5 | 0.008 | 1.18 | <0.01 | 0.61 | 0.01 | bal. | — | — |
| Example 10 | 0.005 | 0.04 | 0.03 | 0.005 | 0.002 | 11.8 | 9.1 | 0.005 | 1.11 | <0.01 | 0.65 | 0.01 | bal. | — | W: 1.6 |
| Example 11 | 0.004 | 0.03 | 0.03 | 0.005 | 0.003 | 11.7 | 9.0 | 0.004 | 1.15 | <0.01 | 0.64 | 0.01 | bal. | 0.4 | W: 0.8 |
| Example 12 | 0.009 | 0.03 | 0.05 | 0.003 | 0.004 | 10.5 | 9.7 | 0.004 | 0.02 | 0.85 | 0.64 | 0.02 | bal. | 0.8 | Co: 3.12 |
| Example 13 | 0.007 | 0.03 | 0.02 | 0.005 | 0.005 | 11.5 | 9.0 | 0.006 | 1.11 | <0.01 | 0.66 | 0.01 | bal. | 1.2 | Co: 8.20 |
| Example 14 | 0.007 | 0.05 | 0.04 | 0.004 | 0.003 | 12.1 | 9.2 | 0.005 | 0.81 | <0.01 | 0.65 | 0.01 | bal. | 1.2 | V: 0.91 |
| Example 15 | 0.006 | 0.03 | 0.02 | 0.004 | 0.005 | 12.0 | 9.4 | 0.005 | 0.78 | <0.01 | 0.61 | 0.01 | bal. | 1.0 | Ta: 0.46 |
| Example 16 | 0.005 | 0.04 | 0.04 | 0.006 | 0.003 | 11.8 | 9.1 | 0.005 | 1.13 | <0.01 | 0.64 | 0.02 | bal. | 1.2 | B: 0.0022 |
| Example 17 | 0.006 | 0.03 | 0.02 | 0.004 | 0.003 | 11.5 | 9.6 | 0.006 | 1.09 | <0.01 | 0.58 | 0.01 | bal. | 1.3 | B: 0.0068 |
| Example 18 | 0.005 | 0.03 | 0.03 | 0.005 | 0.004 | 11.3 | 9.5 | 0.005 | 1.13 | <0.01 | 0.67 | 0.01 | bal. | 1.2 | Ca: 0.0055 |

TABLE 2

| | Component (mass %) | | | | | | | | | | | | | | |
|---|---|---|---|---|---|---|---|---|---|---|---|---|---|---|---|
| | C | Si | Mn | P | S | Ni | Cr | N | Al | Ti | Nb | Cu | Fe | Mo | Others |
| Example 19 | 0.009 | 0.04 | 0.02 | 0.004 | 0.006 | 11.2 | 9.4 | 0.004 | 1.13 | <0.01 | 0.65 | 0.01 | bal. | 1.2 | Mg: 0.0053 |
| Example 20 | 0.010 | 0.03 | 0.02 | 0.005 | 0.005 | 11.7 | 9.5 | 0.005 | 1.23 | <0.01 | 0.71 | 0.02 | bal. | 1.2 | Zr: 0.017 |
| Example 21 | 0.006 | 0.04 | 0.03 | 0.005 | 0.004 | 12.1 | 9.2 | 0.007 | 1.08 | <0.01 | 0.65 | <0.01 | bal. | 1.1 | REM: 0.009 |
| Example 22 | 0.005 | 0.03 | 0.02 | 0.005 | 0.004 | 9.1 | 11.5 | 0.003 | 1.22 | <0.01 | 0.63 | <0.01 | bal. | 1.5 | — |
| Example 23 | 0.003 | 0.03 | 0.03 | 0.005 | 0.003 | 9.3 | 11.3 | 0.004 | 1.15 | <0.01 | 0.65 | 0.01 | bal. | 1.4 | Co: 7.22 |
| Example 24 | 0.011 | 0.04 | 0.02 | 0.005 | 0.003 | 13.1 | 9.2 | 0.005 | 0.01 | 0.84 | 0.58 | 0.02 | bal. | 1.0 | — |
| Example 25 | 0.003 | 0.05 | 0.05 | 0.006 | 0.002 | 13.5 | 8.8 | 0.006 | 1.09 | <0.01 | 0.67 | 0.03 | bal. | 0.9 | — |
| Example 26 | 0.008 | 0.02 | 0.03 | 0.003 | 0.002 | 8.3 | 13.3 | 0.004 | <0.01 | 0.96 | 0.65 | 0.02 | bal. | 2.2 | — |
| Example 27 | 0.005 | 0.03 | 0.03 | 0.005 | 0.003 | 8.8 | 12.7 | 0.005 | 1.11 | <0.01 | 0.61 | <0.01 | bal. | 1.9 | — |
| Example 28 | 0.006 | 0.04 | 0.05 | 0.006 | 0.004 | 12.2 | 8.9 | 0.008 | 1.44 | <0.01 | 0.62 | 0.03 | bal. | 1.1 | — |
| Example 29 | 0.007 | 0.05 | 0.07 | 0.004 | 0.003 | 12.4 | 9.1 | 0.009 | 1.81 | <0.01 | 0.58 | 0.01 | bal. | 1.0 | — |
| Example 30 | 0.004 | 0.04 | 0.03 | 0.005 | 0.006 | 11.8 | 9.0 | 0.008 | 0.75 | <0.01 | 0.73 | 0.02 | bal. | 1.1 | — |
| Example 31 | 0.005 | 0.04 | 0.05 | 0.005 | 0.004 | 12.3 | 9.1 | 0.006 | 0.01 | 1.21 | 0.64 | 0.01 | bal. | 0.9 | — |
| Example 32 | 0.008 | 0.04 | 0.06 | 0.007 | 0.005 | 12.3 | 9.0 | 0.008 | 0.71 | 0.28 | 0.61 | 0.01 | bal. | 1.0 | — |
| Example 33 | 0.005 | 0.04 | 0.07 | 0.005 | 0.004 | 12.3 | 9.0 | 0.006 | 1.21 | 0.25 | 0.58 | 0.01 | bal. | 1.0 | — |
| Example 34 | 0.007 | 0.05 | 0.06 | 0.005 | 0.005 | 12.1 | 8.9 | 0.007 | 0.31 | 0.93 | 0.60 | 0.02 | bal. | 1.1 | — |
| Example 35 | 0.009 | 0.12 | 0.31 | 0.024 | 0.003 | 11.9 | 9.1 | 0.015 | 1.18 | <0.01 | 0.61 | 0.21 | bal. | 1.1 | — |
| Example 36 | 0.009 | 0.09 | 0.29 | 0.021 | 0.003 | 11.8 | 9.1 | 0.013 | 0.72 | <0.01 | 0.61 | 0.15 | bal. | 1.0 | — |

TABLE 3

| | Component (mass %) | | | | | | | | | | | | | | |
|---|---|---|---|---|---|---|---|---|---|---|---|---|---|---|---|
| | C | Si | Mn | P | S | Ni | Cr | N | Al | Ti | Nb | Cu | Fe | Mo | Others |
| Comparative Example 1 | 0.006 | 0.24 | 0.04 | 0.006 | 0.003 | 10.6 | 9.5 | 0.006 | 0.52 | 0.40 | 0.67 | 0.03 | bal. | 1.0 | — |
| Comparative Example 2 | 0.005 | 0.05 | 0.03 | 0.006 | 0.004 | 7.5 | 9.3 | 0.008 | 0.45 | 0.45 | 0.72 | 0.03 | bal. | 1.0 | — |
| Comparative Example 3 | 0.008 | 0.04 | 0.03 | 0.007 | 0.004 | 15.7 | 9.5 | 0.010 | 0.43 | 0.43 | 0.68 | 0.02 | bal. | 1.4 | — |
| Comparative Example 4 | 0.006 | 0.04 | 0.04 | 0.006 | 0.003 | 11.0 | 7.4 | 0.008 | 0.56 | 0.50 | 0.64 | 0.03 | bal | 1.3 | — |
| Comparative Example 5 | 0.006 | 0.05 | 0.02 | 0.005 | 0.005 | 11.1 | 14.9 | 0.009 | 0.45 | 0.52 | 0.71 | 0.02 | bal. | 1.1 | — |
| Comparative Example 6 | 0.007 | 0.05 | 0.01 | 0.006 | 0.008 | 11.5 | 9.1 | 0.008 | 0.44 | 0.55 | 0.73 | 0.02 | bal. | 3.3 | — |

TABLE 3-continued

| | Component (mass %) | | | | | | | | | | | | | | |
|---|---|---|---|---|---|---|---|---|---|---|---|---|---|---|---|
| | C | Si | Mn | P | S | Ni | Cr | N | Al | Ti | Nb | Cu | Fe | Mo | Others |
| Comparative Example 7 | 0.001 | 0.03 | 0.04 | 0.006 | 0.006 | 10.9 | 9.3 | 0.007 | 2.54 | 0.42 | 0.78 | 0.02 | bal. | 1.2 | — |
| Comparative Example 8 | 0.010 | 0.05 | 0.04 | 0.004 | 0.004 | 11.2 | 9.2 | 0.005 | 0.46 | 1.54 | 0.65 | 0.03 | bal. | 1.1 | — |
| Comparative Example 9 | 0.004 | 0.04 | 0.03 | 0.006 | 0.005 | 11.3 | 9.5 | 0.007 | 0.65 | 0.62 | 0.30 | 0.02 | bal. | 1.1 | — |
| Comparative Example 10 | 0.005 | 0.04 | 0.04 | 0.005 | 0.006 | 11.3 | 9.2 | 0.005 | 0.51 | 0.54 | 2.83 | 0.02 | bal. | 1.2 | — |

[2. Test Method]

[2.1. Tensile Test (Measurement of 0.2% Proof Stress)]

A tensile test was performed in accordance with a metal tensile test method specified in ASTM A370 to measure 0.2% proof stress. A test temperature was set as room temperature.

[2.2. Charpy Impact Test]

A 2 mm-V notch test piece was collected so that the longitudinal direction coincided with the extending direction in forging. The test piece was used to measure impact characteristics (absorption energy) in accordance with ASTM A370 standard. A test temperature was set as room temperature or −40° C.

[3. Results]

The results are shown in Tables 4 and 5. The following can be seen from the results.

Regarding 0.2% proof stress (@ RT) in Tables 4 and 5, "A" represents that the 0.2% proof stress at room temperature was 1,400 MPa or more, "B" represents that the 0.2% proof stress was 1,300 MPa or more and less than 1400 MPa, and "C" represents that the 0.2% proof stress was less than 1,300 MPa.

In addition, regarding absorption energy (@ RT), "A" represents that the absorption energy at room temperature was 60 J or more, "B" represents that the absorption energy at room temperature was 40 J or more and less than 60 J, and "C" represents that the absorption energy at room temperature was less than 40 J.

Regarding absorption energy (@−40° C.), "A" represents that the absorption energy at −40° C. was 20 J or more, "B" represents that the absorption energy at −40° C. was 10 J or more and less than 20 J, and "C" represents that the absorption energy at −40° C. was less than 10 J.

(1) Comparative Example 1 showed low absorption energies at room temperature and at −40° C. This is considered to be due to the excessive content of Si.

(2) Comparative Example 2 showed low absorption energies at room temperature and at −40° C. This is considered to be due to the small content of Ni.

(3) Comparative Example 3 showed low 0.2% proof stress at room temperature. This is considered to be due to the excessive content of Ni.

(4) Comparative Example 4 showed low 0.2% proof stress at room temperature. This is considered to be due to the small content of Cr.

(5) Comparative Example 5 showed low absorption energies at room temperature and at −40° C. This is considered to be due to the excessive content of Cr.

(6) Comparative Example 6 showed low absorption energies at room temperature and at −40° C. This is considered to be due to the excessive content of Mo.

(7) Comparative Example 7 showed low absorption energies at room temperature and at −40° C. This is considered to be due to the excessive content of Al.

(8) Comparative Example 8 showed low absorption energies at room temperature and at −40° C. This is considered to be due to the excessive content of Ti.

(9) Comparative Example 9 showed low absorption energies at room temperature and at −40° C. This is considered to be due to the small content of Nb.

(10) Comparative Example 10 showed low absorption energies at room temperature and at −40° C. This is considered to be due to the excessive content of Nb.

(11) Each of Examples 1 to 36 showed high 0.2% proof stress at room temperature, and high absorption energies at room temperature and at −40° C.

TABLE 4

| | 0.2% proof stress (@ RT) | Absorption energy (@ RT) | Absorption energy (@−40° C.) |
|---|---|---|---|
| Example 1 | B | A | A |
| Example 2 | A | B | B |
| Example 3 | A | B | B |
| Example 4 | A | A | B |
| Example 5 | A | A | A |
| Example 6 | A | B | B |
| Example 7 | A | B | B |
| Example 8 | A | B | B |
| Example 9 | B | A | B |
| Example 10 | A | B | B |
| Example 11 | A | B | B |
| Example 12 | A | B | A |
| Example 13 | A | A | A |
| Example 14 | A | B | B |
| Example 15 | A | B | B |
| Example 16 | A | A | A |
| Example 17 | A | B | B |
| Example 18 | A | A | B |
| Example 19 | A | A | B |
| Example 20 | A | A | B |
| Example 21 | A | A | B |
| Example 22 | A | B | B |
| Example 23 | A | B | A |

TABLE 5

| | 0.2% proof stress (@ RT) | Absorption energy (@ RT) | Absorption energy (@−40° C.) |
|---|---|---|---|
| Example 24 | B | A | A |
| Example 25 | B | A | A |
| Example 26 | B | B | B |
| Example 27 | A | B | B |
| Example 28 | A | A | A |
| Example 29 | A | B | B |
| Example 30 | A | A | A |
| Example 31 | A | B | B |

TABLE 5-continued

| | 0.2% proof stress (@ RT) | Absorption energy (@ RT) | Absorption energy (@−40° C.) |
|---|---|---|---|
| Example 32 | B | A | B |
| Example 33 | A | B | B |
| Example 34 | A | B | B |
| Example 35 | A | B | B |
| Example 36 | B | A | B |
| Comparative Example 1 | B | C | C |
| Comparative Example 2 | A | C | C |
| Comparative Example 3 | C | A | A |
| Comparative Example 4 | C | A | A |
| Comparative Example 5 | A | C | C |
| Comparative Example 6 | A | C | C |
| Comparative Example 7 | A | C | C |
| Comparative Example 8 | A | C | C |
| Comparative Example 9 | A | C | C |
| Comparative Example 10 | A | C | C |

Although the embodiments of the present invention have been described in detail above, the present invention is not limited to the above embodiments, and various modifications can be made without departing from the gist of the present invention.

The present application is based on Japanese patent application No. 2020-16838, filed on Feb. 4, 2020 and Japanese patent application No. 2020-177624, filed on Oct. 22, 2020, which contents are incorporated herein by reference.

INDUSTRIAL APPLICABILITY

The precipitation-hardening martensitic stainless steel according to the present invention can be used for (a) a rotor and a stator of a muddy water motor component in a drill for underground drilling, which rotate by hydropower of a fluid, (b) a drive shaft which transmits rotation of the rotor and the stator, (c) a structural member of a bearing which holds the drive shaft, (d) a structural member of measurement-while-drilling tools (MWD) of a drill for underground drilling, which measures a depth, an inclination angle, and an azimuth angle of a drill string, (e) a structural member of logging-while-drilling tools (LWD) which analyzes geological features, and (f) a housing member of MWD or LWD.

In addition, the precipitation-hardening martensitic stainless steel according to the present invention can be used for a steam turbine blade, an aerospace structural member, a high strength fastener, or the like.

The invention claimed is:

1. A precipitation-hardening martensitic stainless steel, consisting of:

an intermetallic compound phase of NiAl,
0<C<0.10 mass %,
0<Si≤0.20 mass %,
0<Mn≤1.00 mass %,
8.0 mass %≤Ni≤15.0 mass %,
8.0 mass %≤Cr≤9.7 mass %,
0.4 mass %≤Nb≤2.50 mass %, and
0.10 mass %≤Al≤2.50 mass %, and
optionally,
Ti<0.10 mass %,
Co≤10.0 mass %,
Mo≤2.5 mass %,
0.8 mass %≤W≤3.0 mass %,
V≤0.91 mass %,
Ta≤1.0 mass %,
B≤0.0100 mass %,
Ca≤0.0100 mass %,
Mg≤0.0100 mass %,
Zr≤0.050 mass %, and
REM≤0.050 mass %, and
the balance being Fe and inevitable impurities.

2. The precipitation-hardening martensitic stainless steel according to claim 1, further satisfying:

0.10 mass %≤Co≤10.0 mass %.

3. The precipitation-hardening martensitic stainless steel according to claim 1, further satisfying at least one of:

0.10 mass %≤Mo≤2.5 mass %,
0.80 mass %≤W≤3.0 mass %,
0.3 mass %≤V≤0.91 mass %,
0.01 mass %≤Ta≤1.0 mass %,
0.0001 mass %≤B≤0.0100 mass %,
0.0001 mass %≤Ca≤0.0100 mass %,
0.0001 mass %≤Mg≤0.0100 mass %,
0.001 mass %≤Zr≤0.050 mass %, and
0.001 mass %≤REM≤0.050 mass %.

4. The precipitation-hardening martensitic stainless steel according to claim 1, having a 0.2% proof stress of 1,300 MPa or more at room temperature.

5. The precipitation-hardening martensitic stainless steel according to claim 1, having an absorption energy of 30 J or more at room temperature.

6. The precipitation-hardening martensitic stainless steel according to claim 4, having an absorption energy of 30 J or more at room temperature.

7. The precipitation-hardening martensitic stainless steel according to claim 1, having an absorption energy of 10 J or more at −40° C.

8. The precipitation-hardening martensitic stainless steel according to claim 4, having an absorption energy of 10 J or more at −40° C.

9. The precipitation-hardening martensitic stainless steel according to claim 5, having an absorption energy of 10 J or more at −40° C.

10. The precipitation-hardening martensitic stainless steel according to claim 6, having an absorption energy of 10 J or more at −40° C.

11. The precipitation-hardening martensitic stainless steel according to claim 1, further satisfying:

8.0 mass %≤Cr≤9.5 mass %.

12. A precipitation-hardening martensitic stainless steel, consisting of:

an intermetallic compound phase of NiAl,
0<C<0.10 mass %,
0<Si≤0.20 mass %,
0<Mn≤1.00 mass %,
8.0 mass %≤Ni≤15.0 mass %,
8.0 mass %≤Cr≤9.7 mass %,
0.4 mass %≤Nb≤2.50 mass %, and
0.10 mass %≤Al≤2.50 mass %, and
optionally
Ti<0.10 mass %,
Co≤10.0 mass %,
Mo≤2.5 mass %,
0.8 mass %≤W≤3.0 mass %,
Ta≤1.0 mass %,
B≤0.0100 mass %, Ca≤0.0100 mass %,
Mg≤0.0100 mass %,
Zr≤0.050 mass %, and
REM≤0.050 mass %, and
the balance being Fe and inevitable impurities.

* * * * *